US006138359A

United States Patent [19]

Mears

[11] Patent Number: 6,138,359

[45] **Date of Patent: *Oct. 31, 2000**

[54] CURVED WALL AND CEILING FRAME MEMBER AND METHOD AND APPARATUS FOR PRODUCING THE SAME

[76] Inventor: Charles W. Mears, 6041 141st Ave., Forest Lake, Minn. 55025

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,404

[22] Filed: Apr. 1, 1997

[51] Int. Cl.[7] ..... B21D 47/00

[52] U.S. Cl. ..... 29/897.312; 72/168; 72/196

[58] Field of Search ..... 29/897.312, 897.3, 29/798, 822; 72/168, 196

[56] References Cited

U.S. PATENT DOCUMENTS

| | | | |
|---|---|---|---|
| 4,875,274 | 10/1989 | Foster | 29/525.1 |
| 5,247,769 | 9/1993 | Becker | 52/484 |
| 5,249,445 | 10/1993 | Morello | 72/9 |
| 5,359,871 | 11/1994 | Morello | 72/7 |
| 5,584,198 | 12/1996 | Morello et al. | 72/8.3 |
| 5,655,282 | 8/1997 | Hodek et al. | 29/469.5 |

*Primary Examiner*—David P. Bryant
*Assistant Examiner*—Marc W. Butler

[57] ABSTRACT

Method and apparatus for producing a predetermining curvature in the flange and web of a structural member including an indexing mechanism and method for controlling the amount of curvature produced.

2 Claims, 12 Drawing Sheets

CURVED WALL AND CEILING FRAME MEMBER AND METHOD AND APPARATUS FOR PRODUCING THE SAME

BACKGROUND OF THE INVENTION

It has been a difficult and time-consuming problem to produce curved frame members to define curved stud wall and ceiling constructions. This has been done in the past by cutting short segments of sheetmetal frame members and attaching these segments to a plywood base panel at the top and bottom of a wall or ends of a ceiling section to define the desired curved configuration. The segments define the desired wall or ceiling curvature and suitably spaced studs are fixed at their ends to the segments to define the prescribed curvature of the wall or ceiling construction.

Another prior art solution has been developed which provides top and bottom wall channels in which the flanges of the channels are formed from a plurality of spaced apart tabs formed by outwardly divergent cut-out notches made in the flanges. The web of the channel between the flanges can then be bent to form the prescribed radius of curvature of the wall and the tabs can be nailed to a plywood backing plate to define the desired curved wall structure. The upper and lower ends of the wall studs are anchored to the curved channels to provide the desired curved wall support structure. This product has been sold in the marketplace under the trademark "Flexi Wall". This "Flexi Wall" product requires that the prescribed curvature of the top and bottom channels to be laid out on the floor and ceiling to define the curved wall.

SUMMARY OF THE INVENTION

The present invention provides a method and apparatus for producing metal channels which are formed into a prescribed curved shape while maintaining the structural integrity of the channel members. No sheetmetal or plywood anchoring plates are required for this construction. The invention includes a device for producing the desired curvature in wall or ceiling channels which support the ends of the members extending between the channels.

The apparatus for producing the curvature includes a die punch for punching out a series of relief holes and indenting dies for indenting both the web and flange portions of the channels. These holes and indentations produce the prescribed curvature in the channels and the apparatus can be easily adjusted to vary the radius of curvature according to the architect's design. The apparatus may also include a die for punching out relief holes in the web of the channels.

The method for producing the curved channels includes indenting the web and the adjacent flange portion to produce the desired curvature in the channel member. The method may also include punching out relief apertures in the channel web.

The prescribed curved channel is produced by a series of cut-outs and indentations formed in the flange end and web of the channel. The cut-outs and indentations are spaced apart a calculated distance to produce the prescribed curvature which may be varied by adjusting the depth and frequency of the indentations formed.

DETAILED DESCRIPTION OF A PREFERRED EMBODIMENT OF THE INVENTION

Figure 1:
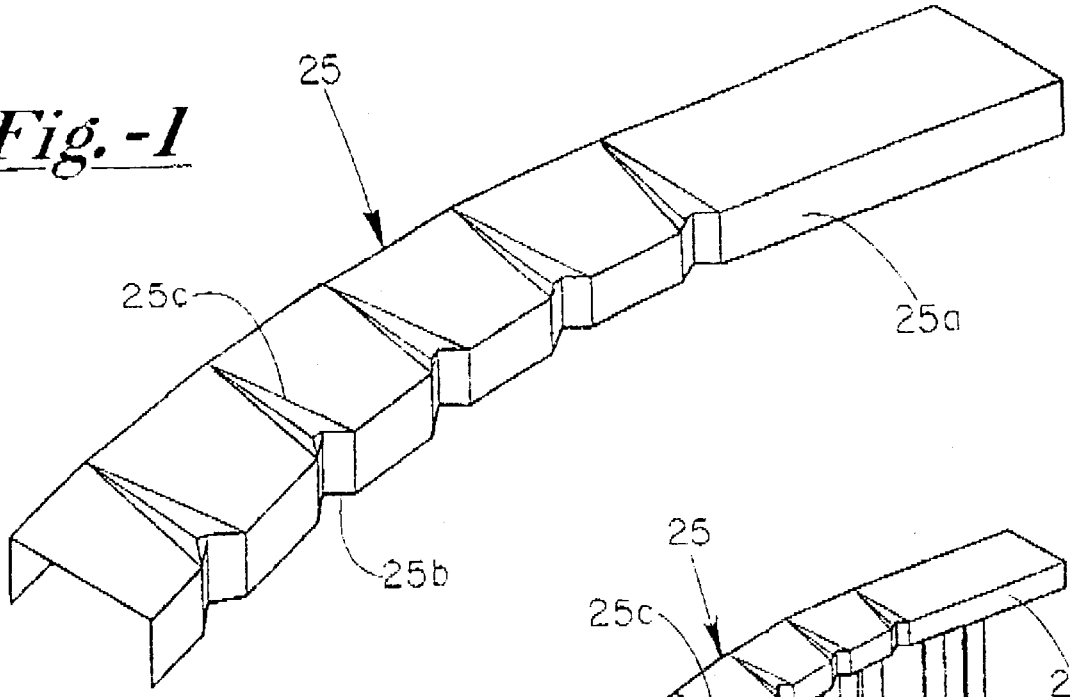
FIG. 1 is a perspective view showing the spaced indentations and notches formed in a curved channel member embodying the invention.
Figure 2A:
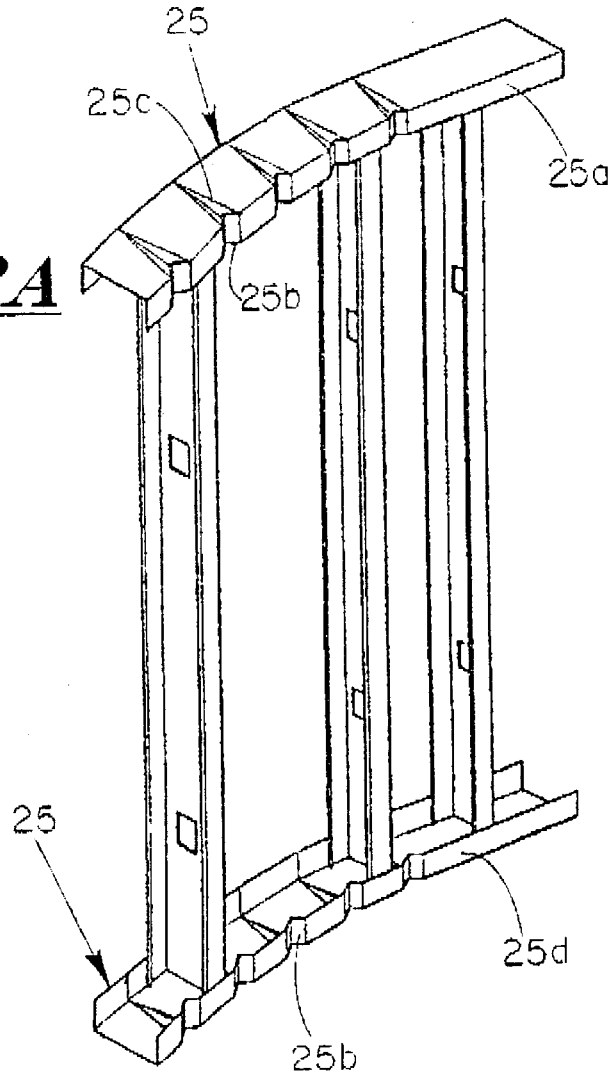
FIG. 2*a* is a perspective view of a curved wall section.
Figure 2B:
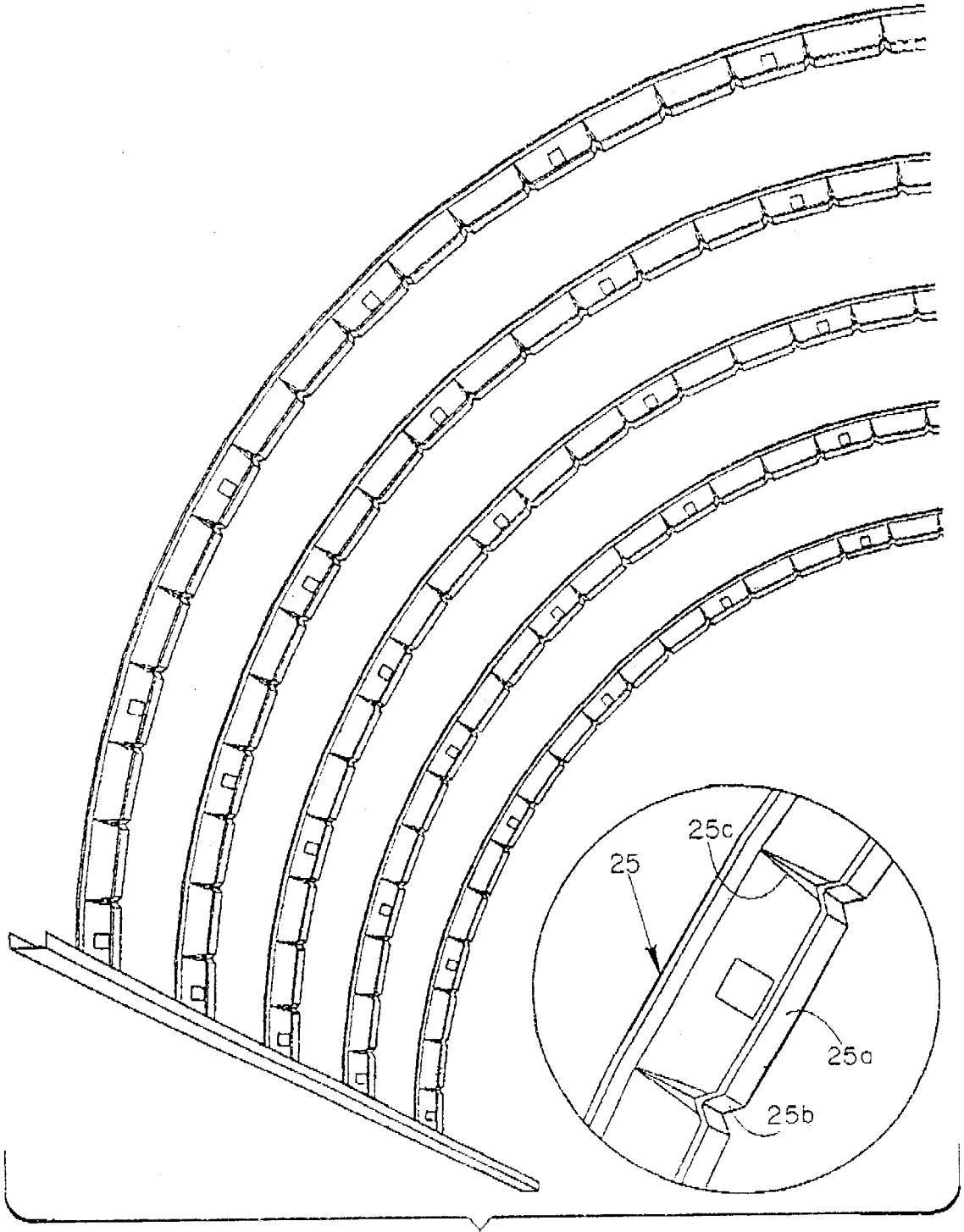
FIG. 2*b* is a perspective view of a curved ceiling section.

The apparatus includes a base 10 for supporting the operating mechanism which is mounted on a suitable bench (not shown). The base 10 has platform 10*a* with a channel-positioning guide track 10*b* for receiving and guiding a channel member 25 to be curved. A pair of upstanding support brackets 11 are fixed to the base 10 and a shaft 12 is journaled for rotation on the upper ends of said brackets 11 as by suitable support pins 12*a*. The shaft is parallel to the track and has an operating handle 14 fixed thereto to provide rotary oscillation of the shaft 12 as will be further described. In the form shown, the shaft 12 is of square cross-sectional shape.

Figure 3A:
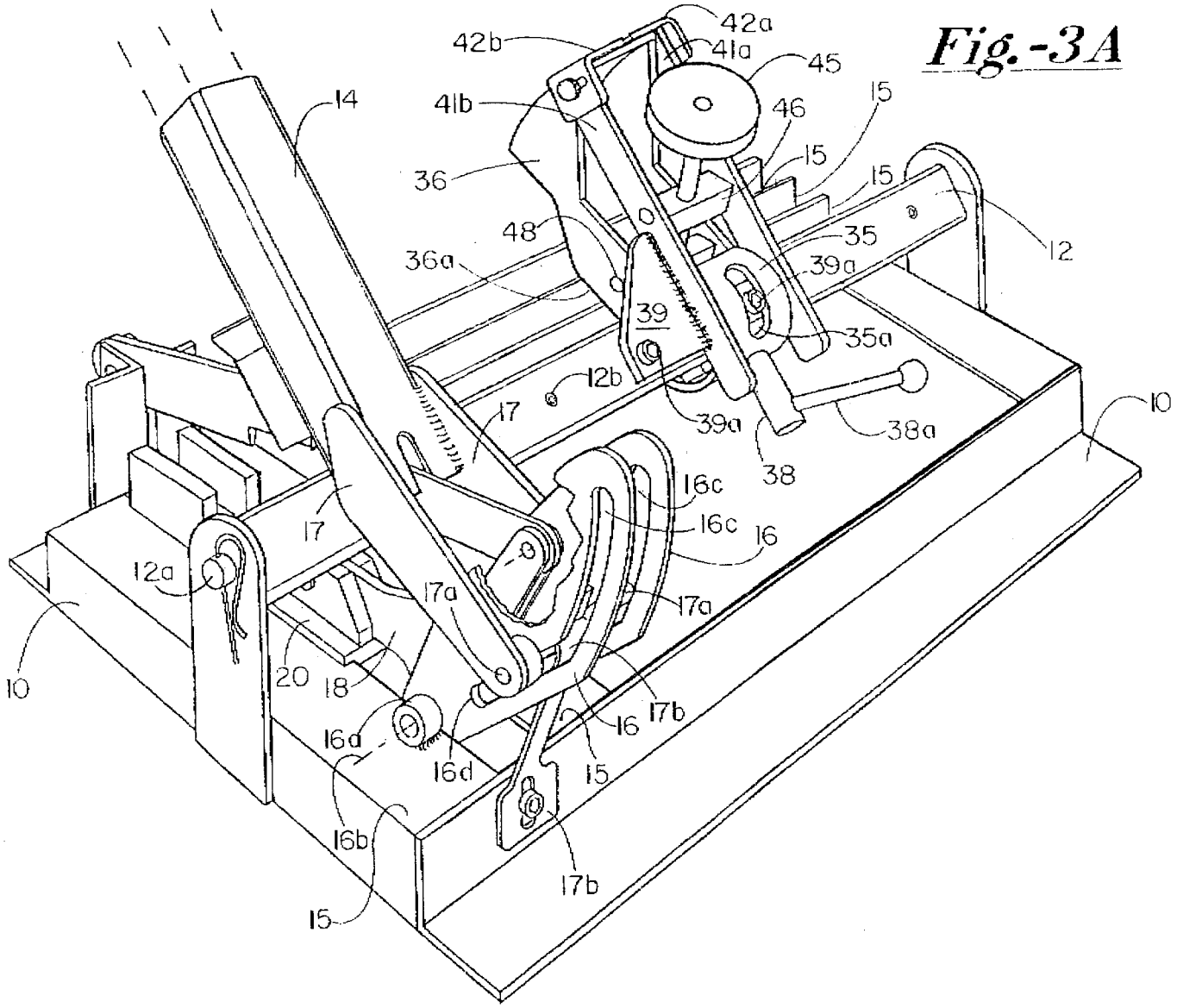
FIG. 3*a* is a perspective view of apparatus embodying this invention.
Figure 3B:
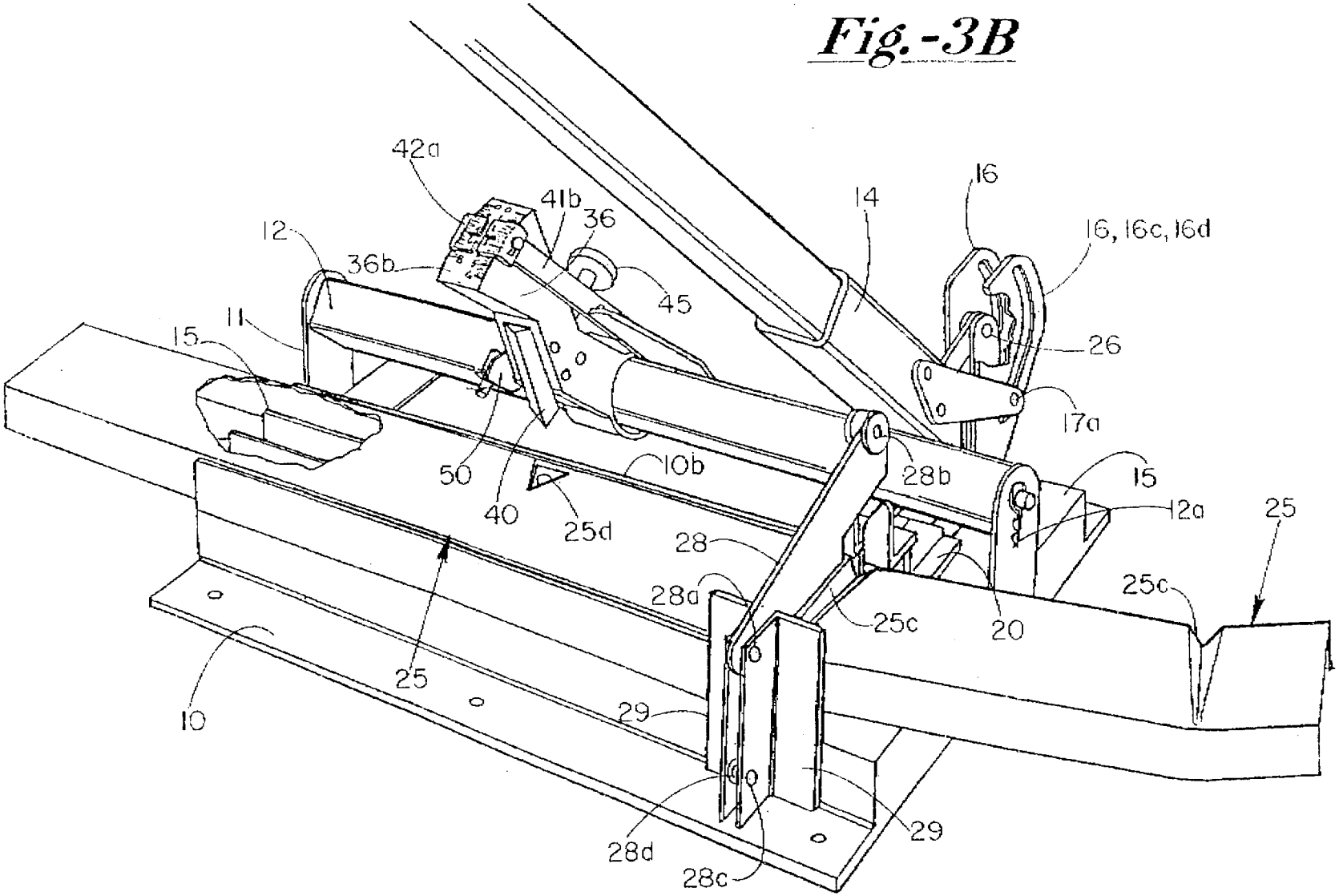
FIG. 3*b* is another perspective view of the apparatus shown in FIG. 3*a* but showing a typical channel member in bending position.

As best shown in FIGS. 3*a* and 3*b*, a pair of spaced cross rails 15 form cross track 15*a* as a part of the base 10. A pair of connected spaced apart oscillating arms 16 are pivoted at the back portion of the cross rails 15 as by bushings 16*a* and a suitable pivot pin 16*b* mounted therein. A pair of connecting arms 17 are fixed to the operating handle 14 as best shown in FIGS. 3*a* and *b* and 4*a, b* and *c*. The oscillating arms 16 are provided with generally arcuately shaped upper slot segments 16*c* and lower slot segments 16*d*. A roller shaft 17*a* is mounted at the rear end portion of arms 17 and rides in the slot segments 16*c* and 16*d*. A spring clip 17*b* is mounted on the base 10 and engages the shaft 17*a* to releasably hold the handle 14 in raised position.

Figure 7:
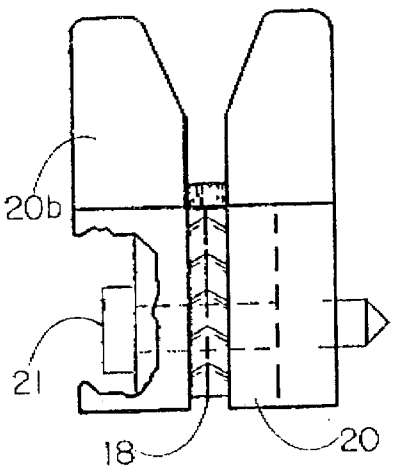
FIG. 7 is a front elevational view of the mechanism shown in FIGS. 5 and 6.
Figure 5:
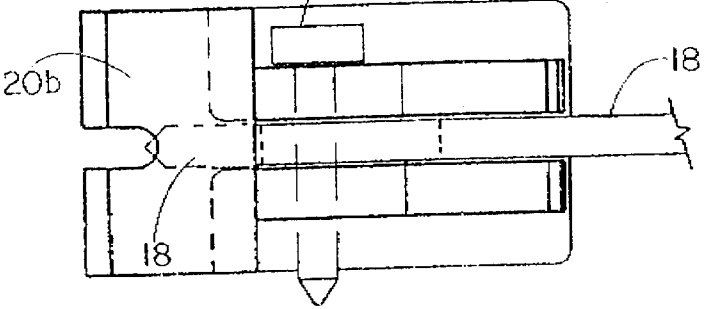
FIG. 5 is a top plan view of the flange indenting die.
Figure 6:
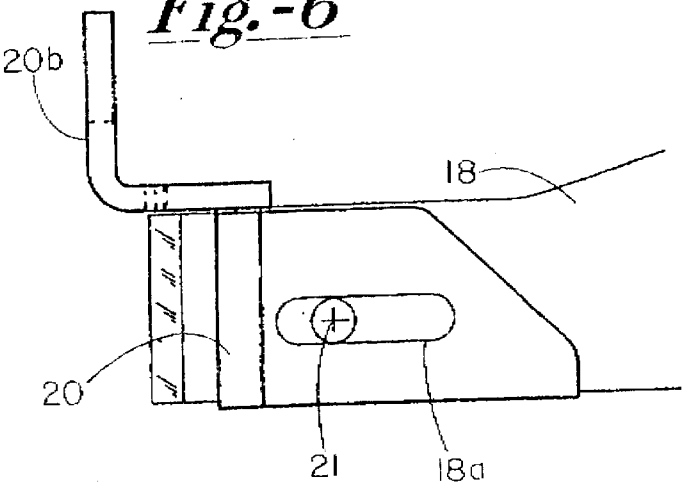
FIG. 6 is a side elevational view of the mechanism shown in FIG. 5.

As best shown in FIGS. 5–7, a flange indenting blade 18 is mounted for sliding movement in a guiding trackway formed in a guide block 20 which is fixed to cross track 15*a*. The guide block 20 has a guide pin 21 fixed thereto and forms a guide for the indenting blade 18 as well as for the channel member 25 being curved. The blade 18 has an elongated guiding slot 18*a* formed therein and the guide pin 21 slides in the slot 18*a*. A confining cap 20*b* is fixed to the forward end of the top of indenting blade 18 and, during the crimping operation, engages and confines the indentation 25*b* being formed in the flange 25*a* of the channel member 25 being curved. The cap 20*b* also serves as a guide for the web indenting blade 28 during actuation thereof.

Figure 8:
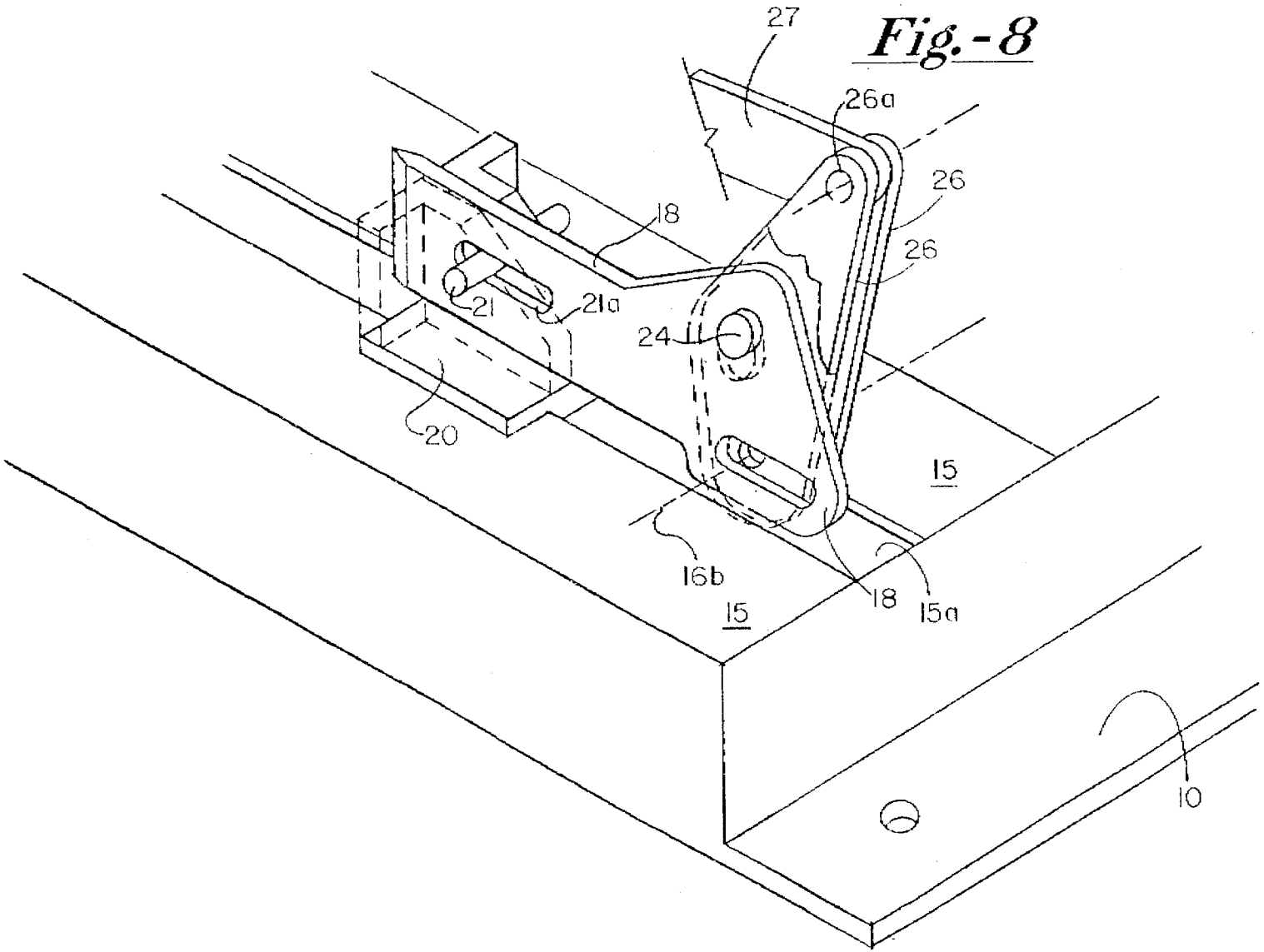
FIG. 8 is a fragmentary perspective view showing the flange indenting mechanism.

As best shown in FIG. 8, the rear end of the indenting blade 18 is connected to a drive shaft 24 which connects the blade to the double actuating arms 26 which are pivoted at their lower ends to the stationary cross shaft 16*b*. The arms 26 are actuated by the handle 14 which is connected thereto by a link 27 and pins 26*a* and 27*a* as best shown in FIGS. 4*a* and 4*b*.

Figure 4A:
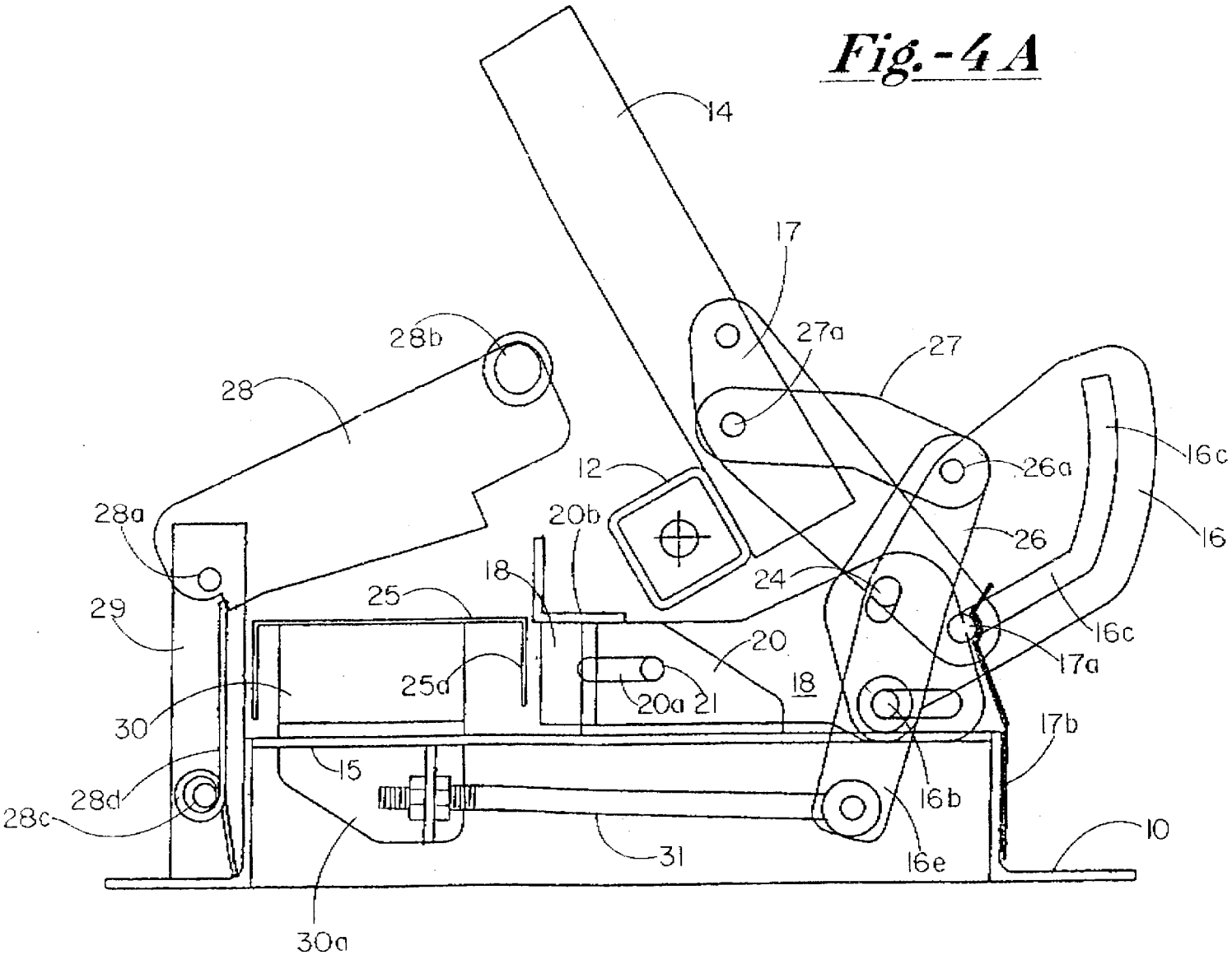
FIG. 4*a* is an end view showing the flange indenting apparatus in raised position.
Figure 4B:
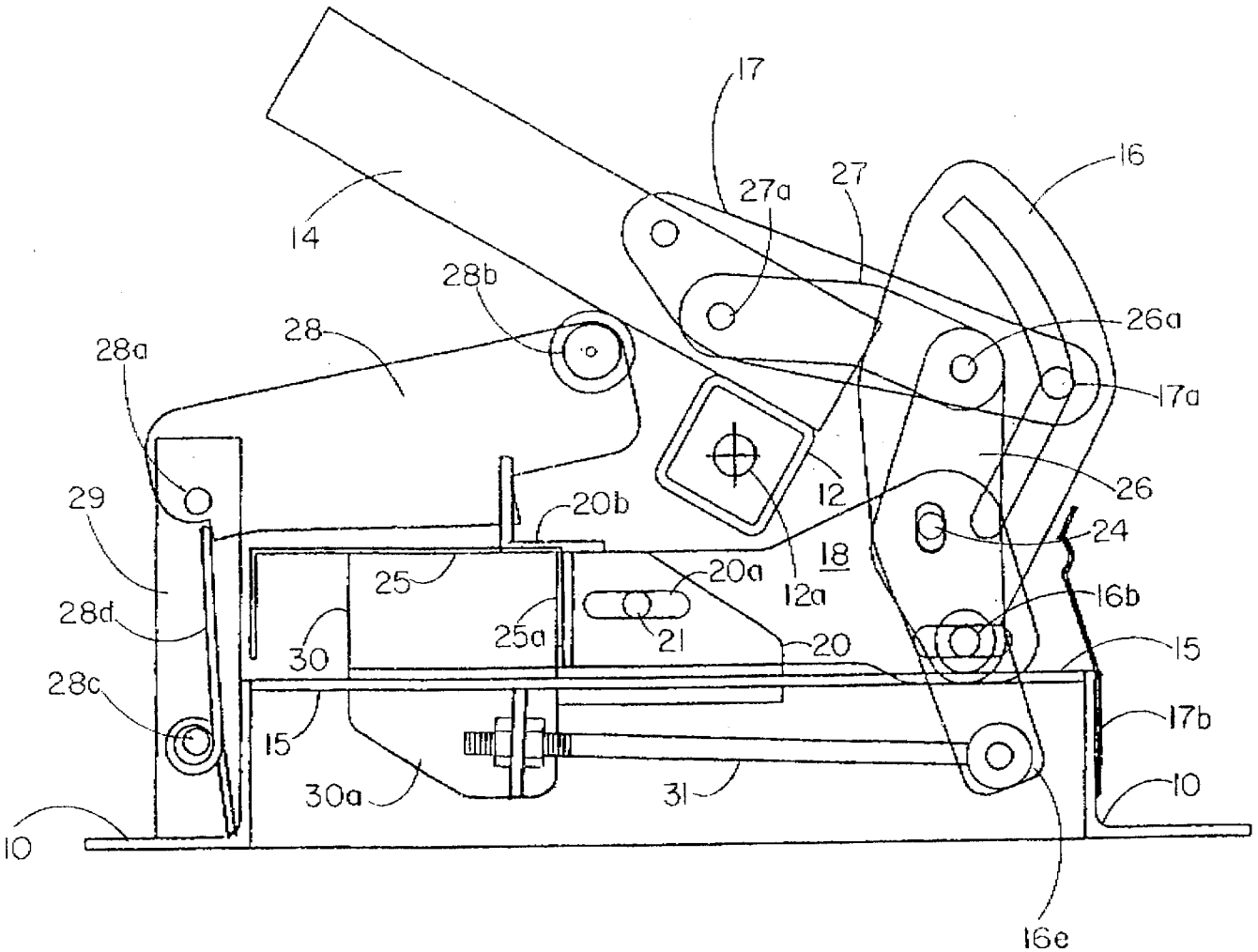
FIG. 4*b* is an end view thereof in partially operative position.

As best shown in FIGS. 4*a* and 4*b*, a front clamping block 30 is slideably mounted in the cross track 15*a* formed by the spaced cross rails 15 of the platform 10. A downwardly extending actuating portion 30*a* of the clamping block 30 is connected by an adjustable link 31 to downwardly extending portions 16*e* of the oscillating arms 16, so that movement of the arms 16, by handle 14, will pull the front clamping block 30 back into backup engagement with the flange 25*a* of channel 25 positioned in the guide track 10*b* as best shown in FIG. 4*a*.

Figure 4C:
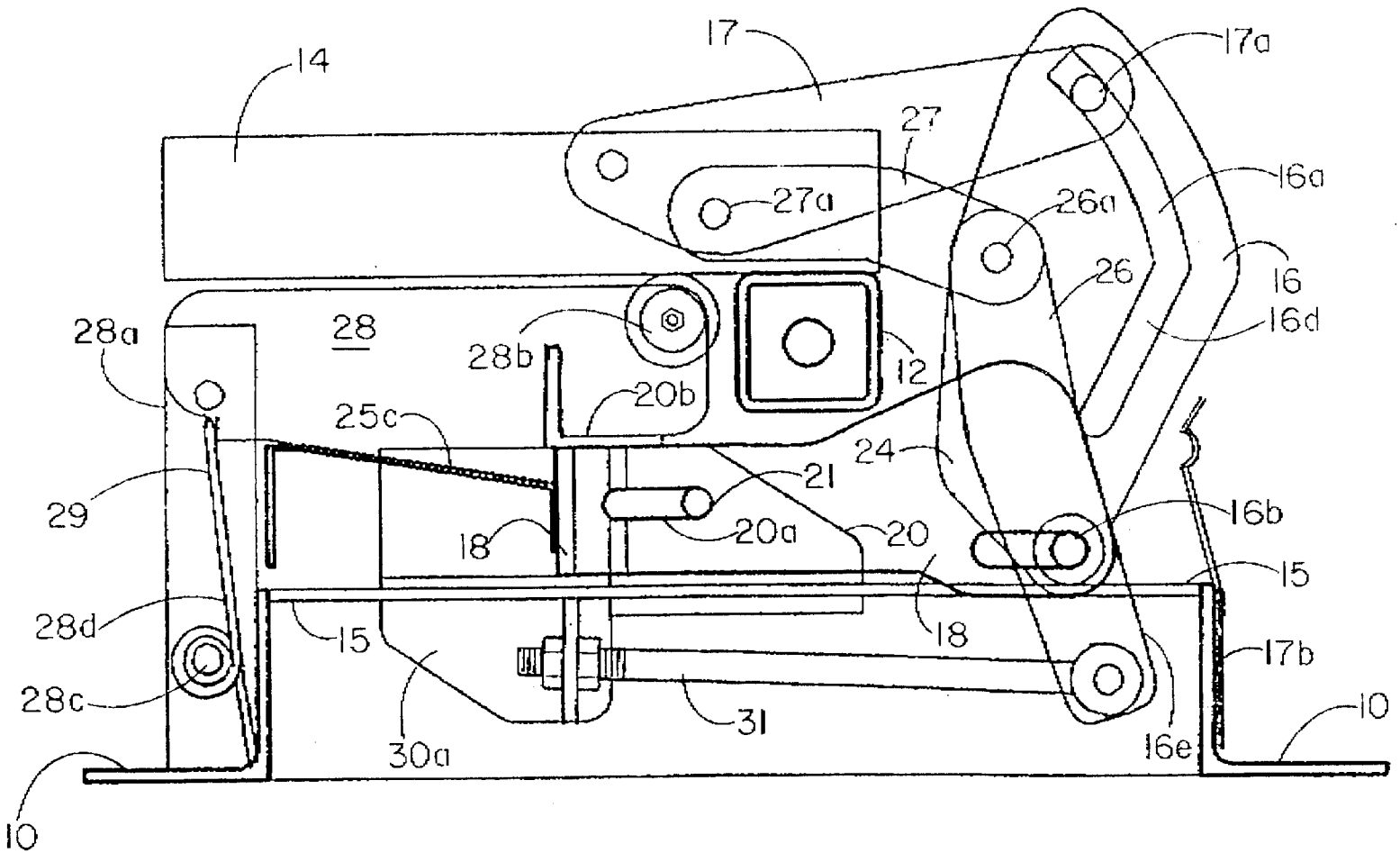
FIG. 4*c* is a view thereof in final flange indenting position.

As best shown in FIGS. 4*a*–4*c*, a web indenting die arm 28 is pivoted at its forward end on pivot pin 28*a* mounted on upstanding support post members 29 fixed to the front of platform 10 as best shown in FIGS. 3*b* and 4*a*–4*c*. A roller 28*b* is journaled on the upper rear end of the arm 28 and is engaged by the bottom surface of the handle 14 during the final stages of the downward operating movement of the handle. A mounting pin 28*c* has a spring 28*d* mounted thereon. The spring resiliently urges the indenting arm 28 upwardly into the retracted position.

Figure 9A:
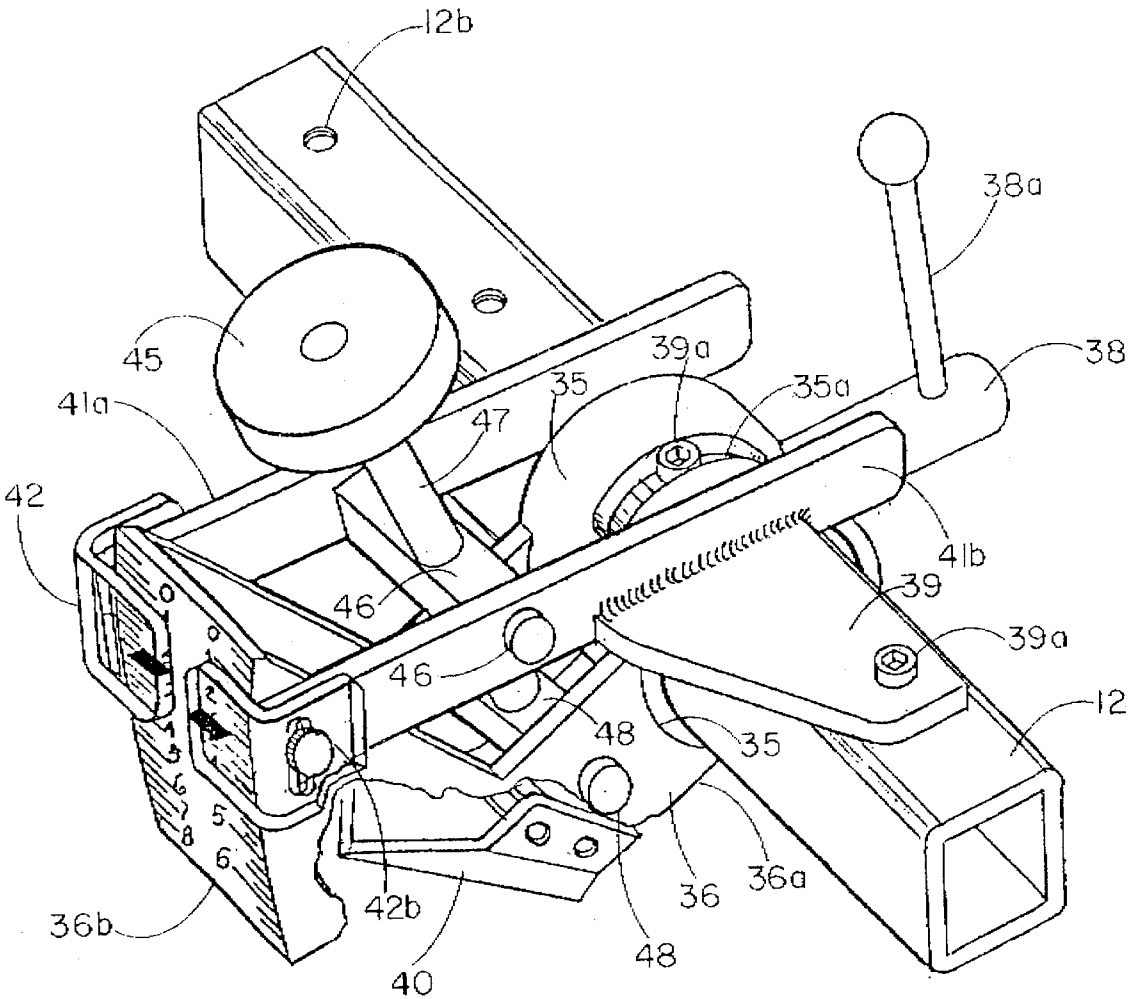
FIG. 9*a* is perspective view of one side of the web piercing mechanism and the adjustment apparatus therefor.
Figure 9B:
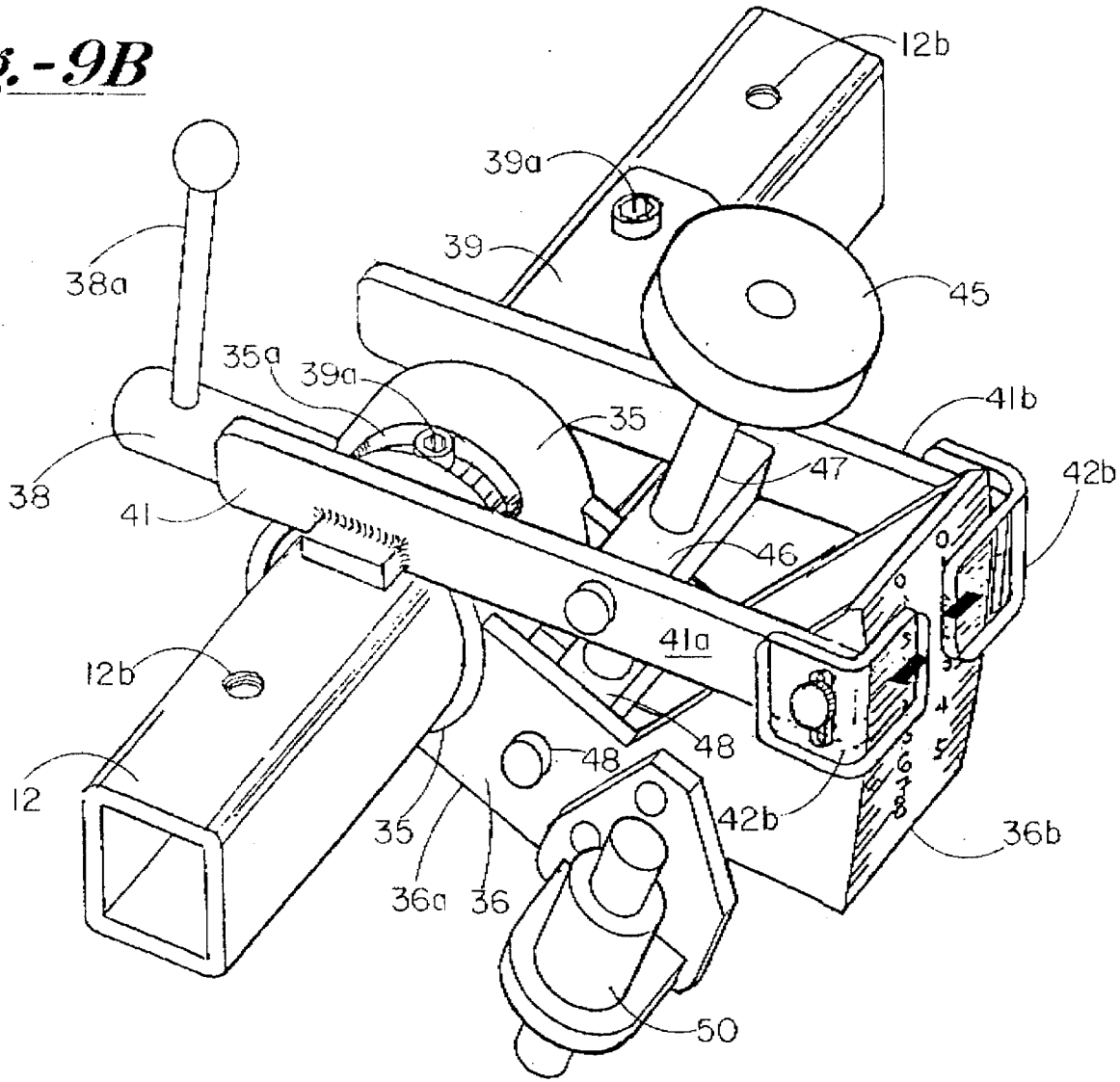
FIG. 9*b* is a perspective view of the other side thereof.
Figure 10:
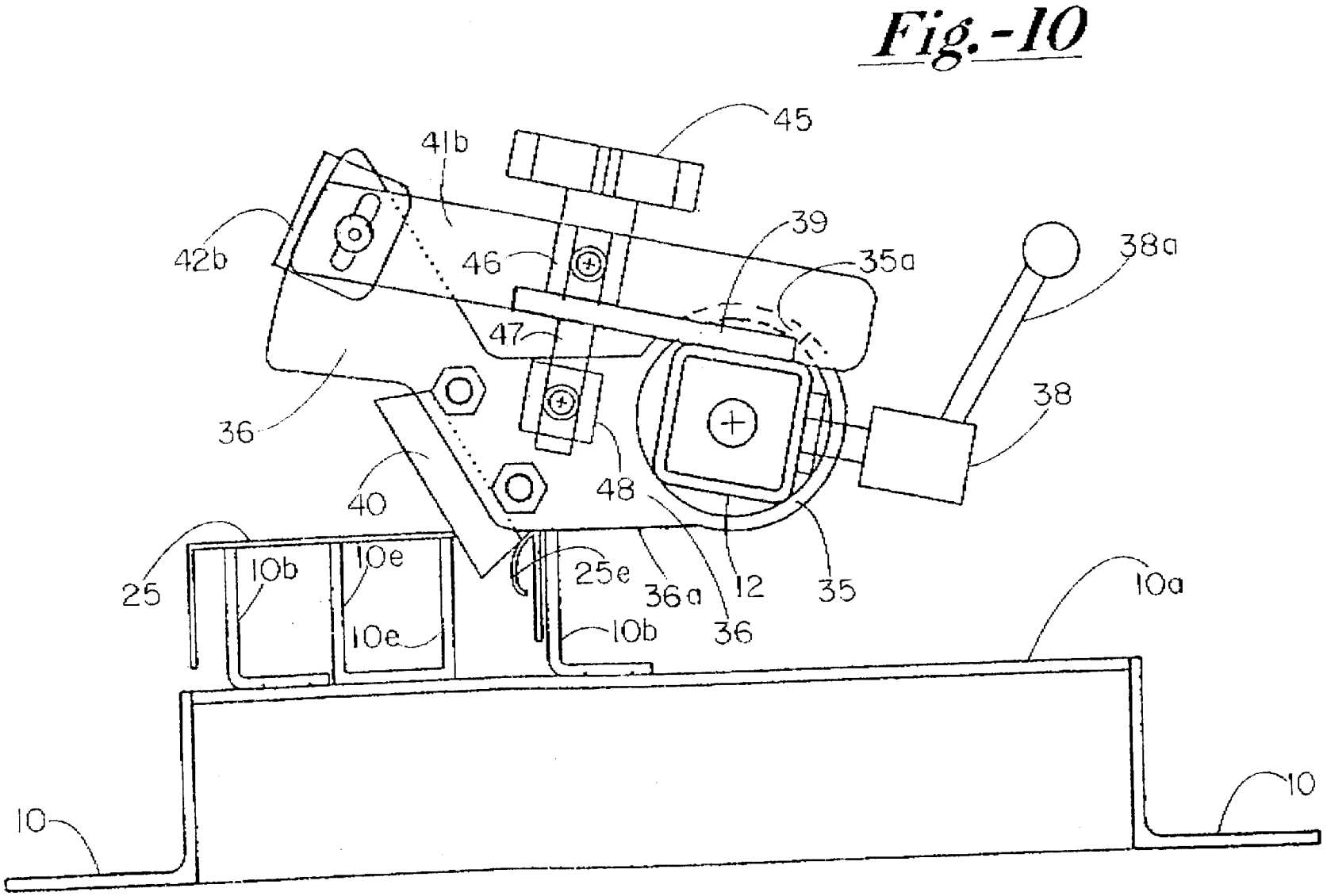
FIG. 10 is an end view of the mechanism shown in FIGS. 9*a* and 9*b*.

An adjustment mechanism controls the depth of the indentations 25*b* and 25*c* formed in the channel member 25 as best shown in FIG. 1. As best shown in FIGS. 9*a* and 9*b*, this adjustment mechanism is mounted on the operating shaft 12. These adjustments are made by limiting the increments of rotational movement the operating shaft 12. This adjustment mechanism includes a sleeve 35 mounted for rotational adjustment on the shaft 12 as best shown in FIGS. 9*a*, 9*b* and FIG. 10. A pair of mounting arms 36 are fixed to the sleeve 35 and include a pair of adjustment indicator scales 36*b* located at the outer ends of the arms 36. Each of these indicator scales 42*a* and 42*b* provides a reference for each specific bending job being run. Operational rotation of the operating shaft 12 is limited by the engagement of the bottom edges 36*a* of the mounting arms 36 with the top edge of rear track element 10*b* of the base platform 10. The indentations 25*b* and 25*c* in the channel 25 produce the curvature in the channel and the depth and spacing of the indentations controls the amount of curvature produced. The adjusted angular position of the arms 36 on the cross shaft 12 controls the increment of rotational movement of the shaft 12 produced by downward actuation of the handle 14. This angular relationship between the shaft 12 and the arms 36 is adjusted for each job by a clamping screw 38 which extends through an arcuate slot 35*a* in the sleeve 35 as best shown in FIGS. 9*a* and 9*b*. A mounting bar 39 is fixed to one side of the square operating shaft 12 by screws 39*a* and underlies the sleeve 35 and extends along the shaft 12 beyond the ends of the sleeve 35.

A piercing die 40 is mounted on the arms 36, as best shown in FIGS. 3*b*, 9*a* and 10, and produces a pierced opening 25*d* in the top web of the channel 25 as indicated by the cut out segment 25*e* as shown in FIGS. 10 and 3*b*. This opening 25*d* provides a visual locator index for the operator to hand-position the channel section 25 on the track 10*b*. Indexing arms 41*a* and 41*b* are welded to the bar 39 which is fixed to the operating shaft 12 by bolts 39*a*, as best shown in FIGS. 9*a* and 9*b*. An indexing scale 36*b* is provided on the free ends of the arms 36 to provide a reading which indicates the desired radius of curvature of the channel 25 being bent according to the architect's specifications. The arms 41*a* and 41*b* are fixed at their rear portions to the operating shaft 12 and are provided with a pair of indexing segments 42*a* and 42*b* respectively connected at their forward ends to the arms 41*a* and 41*b*, as best shown in FIG. 9*a*. The relationship between the arms 41*a* and 41*b* and the mounting arms 36 is adjustable by a screw knob 45 which is rotatably mounted in a cross bar 46 connected to the arms 41*a* and 41*b*. The lower end of the adjusting shaft 47 fixed to the knob 45 is threadably connected to a second cross bar 48 which in turn is connected to the arms 36 as best shown on FIGS. 9*a* and 9*b*. It will be seen that rotation of the knob 45 and shaft 47 will cause the relationship between the arms 41*a* and 41*b* and the die mounting arms 36 to be adjusted, thus adjusting the depth of the indentations 25*b* and 25*c* being produced by the indenting dies 18 and 28. Suitable tapped holes 12*b* are made in the shaft 12 as best shown in FIGS. 9*a* and 9*b* to provide selected locations for the sleeve 35 and arms 36 and web piercing die 40 on the shaft 12. The lower end of the clamping screw 38 engages the surface of the back side of square shaft 12 and locks the sleeve 35 in the desired longitudinal position on shaft 12 to position the piercing die 40. The arms 36 "bottom out" against the top surface of the back rail of the track 10*b* to govern the depth of the indentations 25*b* and 25*c* and thus control the exact radius of curvature of the channel 25 and facilitate easy adjustment of this radius.

As best shown on FIG. 9, an indicator 50 is provided which engages the top of the channel being curved and indicates to the operator that the preset indenting stroke of the operating handle has "bottomed out" so that the operator will discontinue his downward pressure on the operating arm for that particular indenting sequence. The indicator 50 can be in a number of different forms in that it can take the form of a positive stop element as shown in the accompanying drawing or it can take the form of an indicator light which would tell the operator that he has completed that particular indentation operation.

In order to produce the desired indentations in the channel member and thus produce the prescribed curvature in the channel member, the following procedure would be followed. The channel is initially placed on the track 10*b* and the operating handle 14 is pulled downwardly. This rotates the main shaft 12 to which the web indenting arm 28 is fixed and thus the desired indentation of the web at the desired location is produced. The flange indenting blade 18 is mounted for sliding movement on the guiding trackway formed in the guide block 20 and actuated by the arms 26 connected to the operating handle 14. The channel is supported in the guide track 10*b* and is moved progressively the desired increment to produce the prescribed curvature. The piercing die 3 removes material designated as 25*e* in FIG. 10 to provide clearance and a visual locator index for the operator to facilitate hand positioning the channel on the track 10*b* for the next indentations in the flange and web of the channel, and the indentations 25*b* and 25*c* produced by the indenting dies 18 and 28 determine the ultimate radius of curvature of the channel member being curved.

What is claimed is:

1. The method for producing a predetermined curvature in a member having a web and flange, said method comprising, providing a base for supporting a member to be curved, providing a web indenting arm movably mounted on said base for movement into and engagement with a web of the member to be curved, providing a flange indenting blade connected to said base and positioned for movement into engagement with the flange for indenting the same, providing an actuating and guiding mechanism connected with the arm and blade for actuating the arm and blade to produce a predetermined indentation in the web and flange of the member being curved, actuating the arm and blade to produce an increment of curvature in the member being curved by the indentation in the web and flange of the member.

2. The method set forth in claim 1 and adjusting the degree of indentation in the web and flange to vary the amount of curvature in the member being curved.

* * * * *